United States Patent [19]

Green

[11] 4,184,343

[45] Jan. 22, 1980

[54] SAFETY CLUTCH FOR EARRING

[76] Inventor: James W. Green, P.O Box 208, Roxboro, N.C. 27573

[21] Appl. No.: 865,506

[22] Filed: Dec. 29, 1977

[51] Int. Cl.[2] ..... A44C 7/00

[52] U.S. Cl. ..... 63/12; 24/110

[58] Field of Search ..... 63/12, 13; 24/110, 108, 24/211 R, 230 AL

[56] References Cited

U.S. PATENT DOCUMENTS

| | | | |
|---|---|---|---|
| 202,684 | 4/1878 | West et al. | 24/110 |
| 218,864 | 8/1879 | Downs | 24/110 |
| 237,985 | 2/1881 | Lavell | 24/110 |
| 298,987 | 5/1984 | Krementz | 63/12 |
| 680,047 | 8/1901 | King | 24/110 |
| 722,540 | 3/1903 | Schlieper et al. | 24/110 |
| 941,096 | 11/1909 | Pugatsky et al. | 24/230 AL |
| 989,372 | 4/1911 | Lauermann | 24/155 R |
| 1,536,193 | 5/1925 | Deuscher | 24/110 |

FOREIGN PATENT DOCUMENTS

| | | | |
|---|---|---|---|
| 300289 | 9/1917 | Fed. Rep. of Germany | 24/110 |

*Primary Examiner*—Russell R. Kinsey
*Assistant Examiner*—Paul J. Hirsch
*Attorney, Agent, or Firm*—Clarence A. O'Brien; Harvey B. Jacobson

[57] ABSTRACT

A safety clutch for an earring has a body member provided with a through hole arranged for receiving a post of an earring or other article to be releasably attached to the body member. Provided on the body member is a suitable resilient biasing arrangement disposed for normally engaging with the post of the earring and holding the post secure with respect to the body member. The retainer includes a clutch pin slidably disposed in a recess provided in the body member and arranged communicating with the hole so as to cause the clutch pin to selectively come into retaining engagement with a groove provided in the post of the associated earring. A coiled helical spring or other suitable biasing device is disposed in the bottom of the recess, beneath the clutch pin, for forcing the pin toward a position in which the pin engagingly holds the post in place in the hole provided in the body member.

5 Claims, 6 Drawing Figures

SAFETY CLUTCH FOR EARRING

BACKGROUND OF THE INVENTION

1. Field of the Invention

This invention relates generally to pin clutches, and particularly to a safety clutch for use with post earrings, and the like.

2. Description of the Prior Art

The jewelry art commonly employs a device usually referred to as a pin clutch and employed to retain tie tacks, hat pins, post earrings, and the like, in proper position on a wearer or the wearer's clothing. U.S. Pat. Nos. 857,614, issued June 25, 1907, to W. Gaskell, et al., and 1,081,888, issued Dec. 13, 1913, to B. V. Chapman, disclose hat pin clutches wherein spring biased catches selectively engage in a groove or grooves provided on an associated shaft of the hat pin. In particular, the Chapman hat pin guard employs a plunger-like device acting against the bias of a coiled spring in order to normally engage an annular groove provided near the pointed end of a hat pin. Further, U.S. Pat. Nos. 989,372, issued Apr. 11, 1911, to P. Lauermann, and 1,328,954, issued Jan. 27, 1920, to J. S. Graham, disclose hat pin clutches which are simultaneously, like the device disclosed in U.S. Pat. No. 1,081,888, point guards or protectors for the hat pins. U.S. Pat. No. 989,372 uses a coiled spring to bias a clutch pin against the shank of the associated hat pin.

U.S. Pat. No. 1,319,340, issued Oct. 21, 1919, to A. Hurwitz, discloses a scarf pin clutch having a clutch-eye rotatable in a slide mounting which is biased in one direction by a spring, and the clutch-eye having an arm cooperating with a fulcrum so that longitudinal movement of the slide is accompanied by slight turning movement of the eye.

A basic disadvantage of the aforementioned hat pin and scarf clutches, however, is that they are generally not suitable for reduction in size so as to accommodate these known clutches for use with post earrings, tie tacks, and the like.

SUMMARY OF THE INVENTION

It is an object of the present invention to provide a novel, fast, and effective way of preventing the loss of piercedear or post earrings, which prevention is of special importance when the earrings are set with diamonds or other expensive gems.

It is another object of the present invention to provide a simple clutch device suitable for use with post earrings.

Yet another object of the present invention is to provide an attractive yet safe device for retaining earrings, tie tacks, and the like, which device is simple of construction, adaptable to fabrication from various materials, and capable of being provided in various suitable finishes, in different sizes, and in a great variety of shapes.

Still another object of the present invention is to provide a safety clutch capable of securing an earring at any point on the post of the earring, thereby making adjustment possible for different thicknesses of ear lobes.

It is still another object of the present invention to provide a safety clutch capable of being used with screw-type safety nuts simply by forming one or more grooves around the post of the earring near the free end of the post.

These and other objects are achieved according to the present invention by providing a safety clutch having: a body member provided with a through hole arranged for receiving a post of an article to be attached to the body member; and a retainer provided on the body member for normally engaging with the post of the article and holding the article relative to the body member.

The retainer advantageously comprises a clutch pin slidably disposed in a recess provided in the body member and arranged communicating with the hole of the body member. A coiled compression spring or other suitable biasing device is disposed in the bottom of the recess for engaging the pin and forcing same into a position engagingly holding the post of an article being retained in place in the hole provided in the body member.

The clutch pin preferably is a longitudinally extending element having a pair of longitudinally spaced ends, with one of the ends abutting the compression spring and the other of the ends extending out of the recess and being enlarged for forming a button which facilitates depressing of the pin against the force of the spring so as to permit insertion of the post of the article into the hole of the body member and subsequent removal therefrom. A groove is formed in the element intermediate the ends thereof for conformingly receiving the post when the element is depressed against the spring, with the post having one or more indents arranged adjacent the free end thereof for normally receiving the usual circular portion of the extent of the element.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
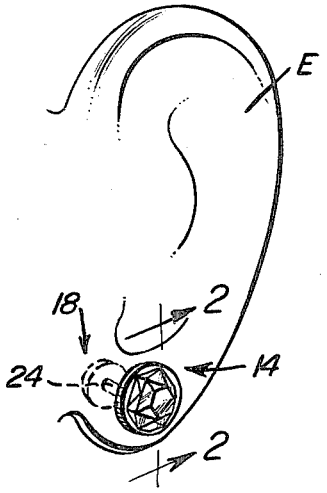
FIG. 1 is a schematic, perspective view showing an earring retained on an ear of a wearer by a safety clutch according to the present invention.
Figure 2:
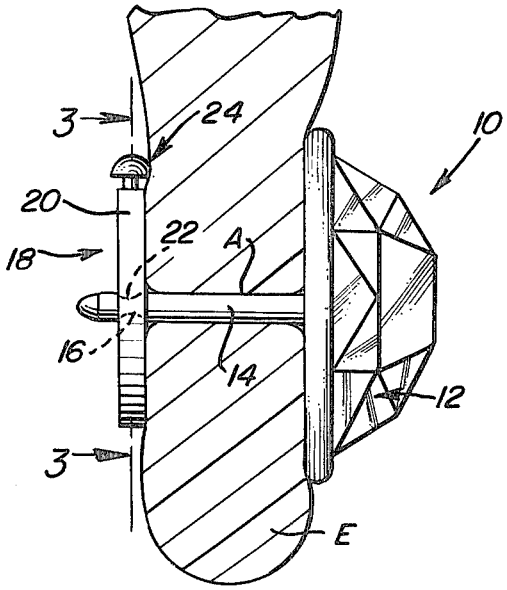
FIG. 2 is a fragmentary, enlarged, sectional view taken generally along the line 2—2 of FIG. 1.
Figure 3:
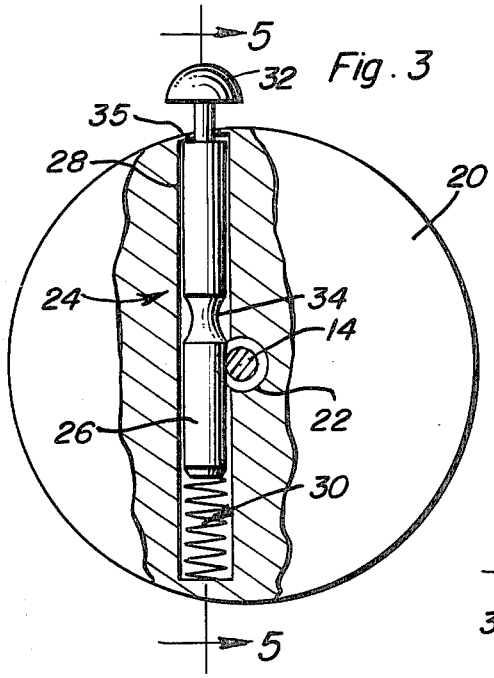
FIG. 3 is an enlarged sectional view taken generally along the line 3—3 of FIG. 2.
Figure 5:
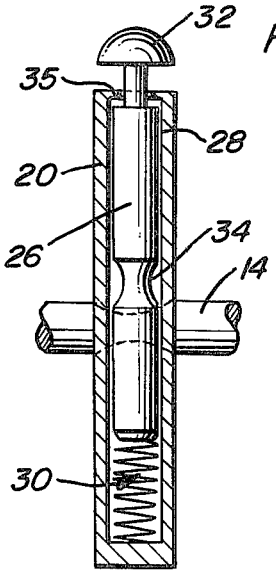
FIG. 5 is a fragmentary, sectional view taken generally along the line 5—5 of FIG. 3.

Referring now more particularly to FIGS. 1 and 2 of the drawing, a post earring 10 is shown as including, in the conventional manner, a decorative head 12 and a stud or post 14 extending cantilever-fashion from head 12. This post 14 is preferably provided with a bevelled indent 16 adjacent the free end thereof, that being the end spaced furtherest from head 12, in order to be retainingly engaged by a safety clutch 18. While only one annular indent 16 is illustrated, it is to be understood that additional indents could be provided along the longitudinal extent of post 14 as desired to facilitate adjustment of clutch 18 with respect to post 14.

Safety clutch 18 includes a body member 20 provided with a through hole 22 arranged for receiving post 14 so as to attach earring 10, or other suitable article (not shown), to body member 20. A retainer 24 is provided on body member 20 for normally engaging with post 14 and holding same secure to body member 20.

Referring now more particularly to FIGS. 3 through 6 of the drawing, the retainer 24 advantageously comprises a generally cylindrical clutch pin 26 slidably disposed in a substantially cylindrical recess 28 provided in body member 20 and communicating with hole 22. More specifically, body member 20 advantageously is in the form of the illustrated disk having a pair of substantially parallel circular faces and a rim extending between peripheral portions of the faces, with hole 22 being provided at the center of the faces and the recess 28 extending inwardly toward hole 22 from the rim of the disk. Arranged in the bottom of recess 28 is a biasing device in the form of a coiled compression spring 30 arranged for engaging pin 26 and forcing same toward a position wherein the pin engagingly holds post 14 in place within hole 22.

Figure 4:
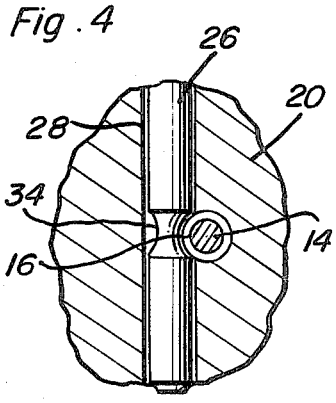
FIG. 4 is a detail, sectional view showing the central portion of FIG. 3, but with the clutch pin of the safety clutch according to the invention in a different position than seen in FIG. 3.
Figure 6:
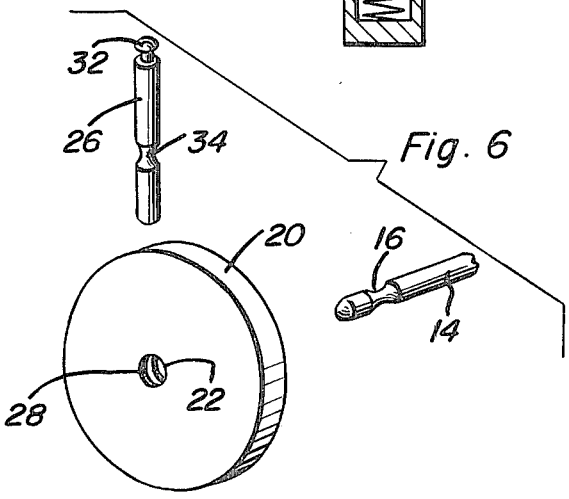
FIG. 6 is an exploded, perspective view showing some of the elements of a safety clutch according to the present invention.

Clutch pin 26 is, as illustrated, a longitudinally extending element having a pair of longitudinally spaced ends, one of the ends arranged abutting the spring 30 and the other of the ends extending out of recess 28 and beyond the rim of body member 20, and is enlarged for forming a button 32 which facilitates depressing of pin 26 against the bias of spring 30. A groove 34 is formed in pin 26 intermediate the longitudinally spaced ends thereof for conformingly receiving the post 14 when pin 26 is depressed against spring 30. Provision of this annular groove 34 permits post 14 to slide past pin 26 when same is in the depressed mode, as seen in FIG. 4, while releasing pin 26 so as to permit it to move outwardly under the bias of spring 30, to the position seen in FIG. 3, will cause post 14 to become retained within hole 22 of body member 20 due to engagement of the generally cylindrical periphery of pin 26 in the indent 16 provided on post 14.

The metal of body 20 is burnished around recess 28 to form a lip 35 which prevents pin 26 from sliding out of recess 28 when the earring post 14 is not inserted in hole 22.

As can be readily understood from the above description and from the drawings, a safety clutch according to the present invention permits an earring of small size to be safely retained on a pierced-ear, without risk of injury to the wearer and most importantly without risk of loss of the earring.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A jewelry clutch including first and second members to be releasably anchored relative to each other, one of said members including a cylindrical anchor post projecting outwardly therefrom and including an outer free end, said post including a continuous circumferential anchor groove formed therein a spaced distance inwardly from the outer free end thereof, the other of said members defining a first endwise outwardly opening passage formed therein and into which said post is removably telescopingly received, said other member also defining a second endwise outwardly opening passage formed therein intersecting with said first passage at generally right angles relative thereto and with the center axis of said first passage laterally offset to one side of the center axis of said second passage in an amount equal to less than one-half the transverse dimension of said first passage, a cylindrical locking post reciporcally mounted in said second passage for lengthwise shifting between first and second positions, in each of which positions said locking post is registered with said first passage, means yielding biasing said locking post toward said first position, said locking post having a continuous circumferential release groove formed therein, said release groove, when said locking post is in said first position, being positioned out of registry with said first passage and when said locking post is in said second position being positioned in registry with said first passage, said anchor post being positionable in said first passage with said anchor groove registered with said second passage for receiving said locking post, spaced from said release groove, in said anchor groove to lock said anchor post against lengthwise shifting in said first passage, and said release groove, when said locking post is shifted to said second position, being registered with said first passage to provide clearance for said anchor post to be shifted longitudinally of and withdrawn from said first passage.

2. The combination of claim 1 wherein said grooves are partial circular in transverse cross sectional shape.

3. The combination of claim 1 wherein said anchor post comprises the clutch post of an earring and said other member comprises the safety clutch body of an earring.

4. The combination of claim 1 wherein said locking post and other member include coacting abutment portions defining a limit of movement of said locking post toward said first position.

5. The combination of claim 4 wherein said other member comprises a generally circular disc, said first passage comprising an axial passage through said disc and said second passage extends generally radially of said disc.

* * * * *